US010988831B2

(12) United States Patent
Nourbakhsh Shorabi et al.

(10) Patent No.: US 10,988,831 B2
(45) Date of Patent: Apr. 27, 2021

(54) PRODUCTION OF METAL MATRIX NANOCOMPOSITES

(71) Applicants: Seyed Hassan Nourbakhsh Shorabi, Shahr-e-kord (IR); Mohammad Amin Shahrokhian Dehkordi, Shahr-e-kord (IR); Meysam Hassanzadeh Soreshjani, Shahr-e-kord (IR)

(72) Inventors: Seyed Hassan Nourbakhsh Shorabi, Shahr-e-kord (IR); Mohammad Amin Shahrokhian Dehkordi, Shahr-e-kord (IR); Meysam Hassanzadeh Soreshjani, Shahr-e-kord (IR)

( * ) Notice: Subject to any disclaimer, the term of this patent is extended or adjusted under 35 U.S.C. 154(b) by 155 days.

(21) Appl. No.: 16/175,262

(22) Filed: Oct. 30, 2018

(65) Prior Publication Data

US 2019/0062873 A1 Feb. 28, 2019

Related U.S. Application Data

(60) Provisional application No. 62/579,899, filed on Nov. 1, 2017.

(51) Int. Cl.

| | |
|---|---|
| ***B22D 19/04*** | (2006.01) |
| ***C22C 1/10*** | (2006.01) |
| ***C22C 32/00*** | (2006.01) |
| ***B22D 19/14*** | (2006.01) |

(52) U.S. Cl.

CPC ..... *C22C 1/1036* (2013.01); *B22D 19/04* (2013.01); *B22D 19/14* (2013.01); *C22C 32/0026* (2013.01); *C22C 32/0036* (2013.01); *C22C 2001/1047* (2013.01)

(58) Field of Classification Search

CPC ..... B22D 19/14; B22D 17/28; C22C 1/1036; C22C 32/0026; C22C 32/0036; C22C 2001/1047; B01F 13/0211; B01F 3/06; B01F 3/1221; B01F 7/007; B01F 7/22

See application file for complete search history.

(56) References Cited

U.S. PATENT DOCUMENTS 5,531,425 A * 7/1996 Skibo ..... B01F 7/166 164/270.1
5,860,468 A * 1/1999 Cook ..... B22D 17/14 164/113

(Continued)

FOREIGN PATENT DOCUMENTS

GB 719716 A * 12/1954 ..... C10J 3/506

*Primary Examiner* — Kevin E Yoon

(74) *Attorney, Agent, or Firm* — Bajwa IP Law Firm; Haris Zaheer Bajwa

(57) ABSTRACT

A method and apparatus for producing metal matrix nanocomposites is disclosed. The method may include obtaining a nanodispersion by dispersing a plurality of nanoparticles into an inert gas within a dispersion chamber. Dispersing the plurality of nanoparticles into the inert gas may include injecting a pressurized stream of the inert gas into the dispersion chamber, and mechanically mixing the inert gas and the plurality of nanoparticles. The method may further include injecting the nanodispersion into a volume of molten metal, obtaining a molten mixture by mechanically mixing the nanodispersion with the volume of molten metal, and applying a casting process on the molten mixture by transferring the molten mixture into a die.

14 Claims, 16 Drawing Sheets

(56) References Cited

U.S. PATENT DOCUMENTS

| | | | | |
|---|---|---|---|---|
| 6,860,314 | B1 * | 3/2005 | Koide | B22D 17/007 164/113 |
| 2015/0238913 | A1 * | 8/2015 | Luharuka | B01F 7/00641 366/138 |
| 2016/0060730 | A1 * | 3/2016 | Li | C22C 1/1036 420/554 |
| 2016/0101392 | A1 * | 4/2016 | Yang | C22C 1/1026 366/139 |

* cited by examiner

PRODUCTION OF METAL MATRIX NANOCOMPOSITES

CROSS-REFERENCE TO RELATED APPLICATION

This application claims the benefit of priority from U.S. Provisional Patent Application Ser. No. 62/579,899, filed on Nov. 1, 2017, and entitled "APPARATUS FOR MULTI-PURPOSE MANUFACTURING LIGHT METAL COMPOSITES," which is incorporated herein by reference in its entirety.

TECHNICAL FIELD

The present disclosure relates to nanocomposites, particularly to metal matrix nanocomposites, and more particularly to methods and devices for producing metal matrix nanocomposites.

BACKGROUND

Metal matrix composites consist of a ductile metal matrix and hard reinforcing particles. Metal matrix composites offer better mechanical properties such as lower density, higher specific strength, higher fatigue resistance, and more dimensional stability at elevated temperatures, compared to mechanical properties of conventional alloys. Different methods are available for production of metal matrix composites such as mechanical alloying with high energy stir casting methods, powder metallurgy, and solid state methods. Stir casting methods are widely used in the industry due to their simplicity, flexibility, and cost-effectiveness. Furthermore, stir casting methods enable the production of large components.

However, production of metal matrix composites by stir casting methods is associated with limitations due to low wettability of the reinforcing particles by the molten metal. Consequently, ensuring a proper distribution of the reinforcing particles in the metal matrix is an important factor that may significantly impact the final properties of the produced metal matrix composites, especially at nanoscales. Because of high surface to volume ratio of nanoparticles, their tendency toward agglomeration is very high and as a result, increasing the wettability of nanoparticles by achieving a uniform distribution of the nanoparticles in the molten metal is difficult. Therefore, there is a need for development of efficient methods and techniques for increasing the wettability of nanoparticles by the molten metal in stir casting methods.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments, the present disclosure is directed to an exemplary method for producing metal matrix nanocomposites. The method may include obtaining a nanodispersion by dispersing a plurality of nanoparticles into an inert gas within a dispersion chamber. Dispersing the plurality of nanoparticles into the inert gas may include injecting a pressurized stream of the inert gas into the dispersion chamber, and mechanically mixing the inert gas and the plurality of nanoparticles. The method may further include injecting the nanodispersion into a volume of molten metal, obtaining a molten mixture by mechanically mixing the nanodispersion with the volume of molten metal, and applying a casting process on the molten mixture by transferring the molten mixture into a die.

In an exemplary embodiment, injecting the pressurized stream of the inert gas into the dispersion chamber may include injecting the pressurized stream of the inert gas into a cylindrical dispersion chamber through a tangential inlet port intersecting the cylindrical dispersion chamber.

In an exemplary embodiment, injecting the pressurized stream of the inert gas into the dispersion chamber may include injecting the pressurized stream of the inert gas into a cylindrical dispersion chamber through a tangential inlet port intersecting a lower portion of the cylindrical dispersion chamber.

In an exemplary embodiment, mechanically mixing the inert gas and the plurality of nanoparticles lude mixing the inert gas and the plurality of nanoparticles by a first mixing mechanism disposed within the dispersion chamber. The first mixing mechanism may include at least one axial-flow impeller mounted on an impeller shaft, the impeller shaft driven by an impeller actuator.

In an exemplary embodiment, injecting the pressurized stream of the inert gas into the dispersion chamber may include injecting the pressurized stream of the inert gas into the dispersion chamber such that the pressurized stream of the inert gas is injected tangential to a trailing-edge circle of the at least one axial-flow impeller.

In an exemplary embodiment, transferring the molten mixture into the die may include pouring the molten mixture into a pumping chamber, and forcing the molten mixture into a die by a ram movably disposed within the pumping chamber. The ram may direct the molten metal within the pumping chamber into the die.

In an exemplary embodiment, injecting the nanodispersion into a volume of molten metal may include injecting the nanodispersion into the volume of molten metal through an injection line in fluid communication with a discharge port. The discharge port may intersect an upper portion of the cylindrical dispersion chamber.

In an exemplary embodiment, mechanically mixing the nanodispersion with the volume of molten metal may include mixing the nanodispersion with the volume of molten metal in a crucible by a second mixing mechanism disposed within the crucible. The second mixing mechanism may include at least one impeller inserted into the molten mixture. Injecting the nanodispersion into the volume of molten metal may include injecting the nanodispersion into the volume of molten metal immediately above the at least one impeller.

According to one or more exemplary embodiments, the present disclosure is directed to an apparatus for producing metal matrix nanocomposites. An exemplary apparatus may include a dispersion mechanism configured to disperse a plurality of nanoparticles into an inert gas. The dispersion mechanism may include an air-tight cylindrical dispersion chamber, wherein the plurality of nanoparticles poured into the cylindrical chamber, a first mechanical mixer disposed within the air-tight cylindrical chamber, a tangential inlet port intersecting the air-tight cylindrical dispersion chamber, and a discharge port intersecting the air-tight cylindrical dispersion chamber. A pressurized stream of the inert gas may be injected into the cylindrical dispersion chamber via the tangential inlet port, and the first mechanical mixer may be configured to mix the inert gas and the plurality of nanoparticles to obtain a nanodispersion. An exemplary apparatus may further include an air-tight crucible heated by a furnace, a second mechanical mixer disposed within the air-tight crucible, and an injection probe partially inserted into the air-tight crucible. The injection probe may be configured to provide a fluid communication between the discharge port of the dispersion mechanism and the air-tight crucible and inject the nanodispersion into the volume of molten metal. The second mechanical mixer may be configured to mechanically mix the nanodispersion with the volume of molten metal to obtain a molten mixture.

In an exemplary embodiment, the tangential inlet port may tangentially intersect a lower portion of the air-tight cylindrical dispersion chamber. The discharge port may intersect an upper portion of the air-tight cylindrical dispersion chamber.

In an exemplary embodiment, the first mechanical mixer may include a first mechanical actuator, a first impeller shaft that may be coupled with the first mechanical actuator, and at least one axial-flow impeller that may be disposed within the air-tight cylindrical dispersion chamber. The at least one axial-flow impeller may be mounted on the first impeller shaft. The pressurized stream of the inert gas may be injected via the tangential inlet port tangential to a trailing edge circle of the at least one axial-flow impeller.

In an exemplary embodiment, the second mechanical mixer may include a second mechanical actuator, a second impeller shaft that may be coupled with the second mechanical actuator, and at least one impeller that may be dipped into the molten metal within the air-tight crucible. The at least one impeller may be mounted on the second impeller shaft. The injection probe may inject the nanodispersion into the volume of molten metal immediately above the at least one impeller.

In an exemplary embodiment, an exemplary apparatus may further include a die-casting mechanism that may be configured to apply a die casting process on the molten mixture. The die-casting mechanism may include a pumping chamber that may be selectively in fluid communication with the air-tight crucible. The pumping chamber may be configured to receive the molten mixture, and a ram may be removably disposed within the pumping chamber and be adapted to direct the molten mixture into an opening of a die.

In an exemplary embodiment, an exemplary air-tight crucible may further include a lower discharge opening, and the pumping chamber may further include an upper inlet opening that may be positioned immediately bellow the lower discharge opening.

In an exemplary embodiment, the ram may be configured to direct the molten mixture into the opening of the die by traveling within the pumping chamber, upon actuation by an actuator, from a first position upstream of the upper inlet port to a second position downstream of the upper inlet port adjacent the opening of the die.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1A:
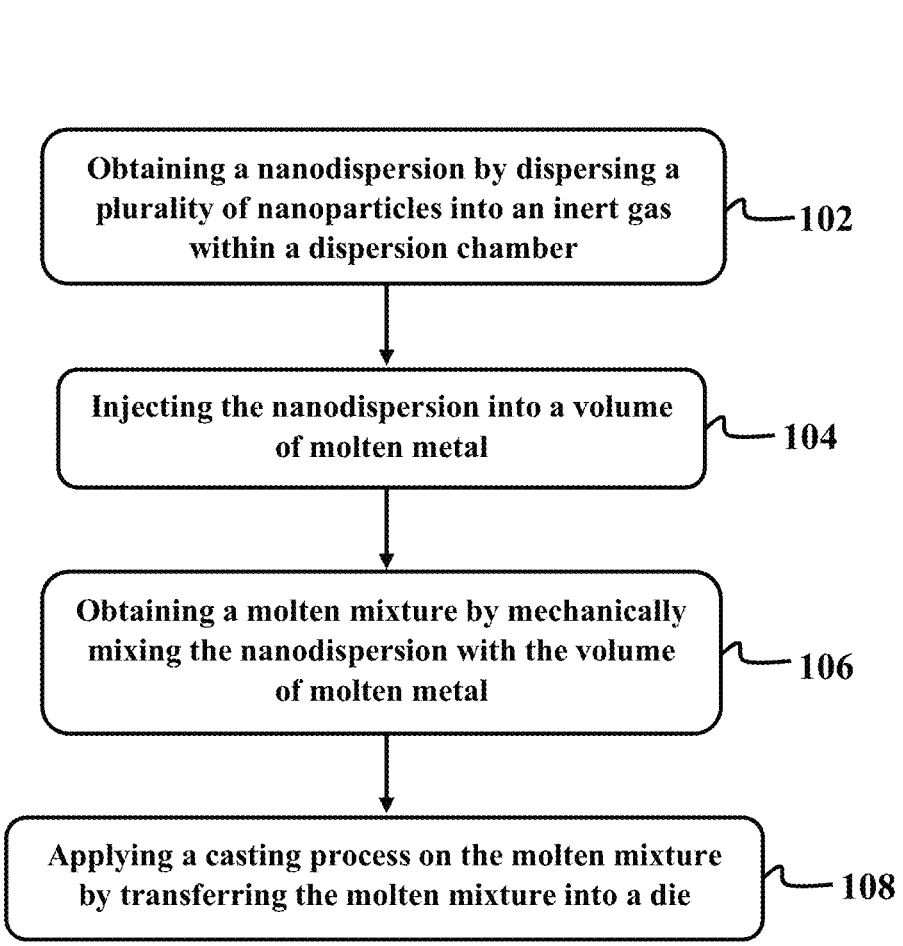
FIG. 1A illustrates a method for producing metal matrix nanocomposites, consistent with one or more exemplary embodiments of the present disclosure.

In the following detailed description, numerous specific details are set forth by way of examples to provide a thorough understanding of the relevant teachings related to the exemplary embodiments. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be plain to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

The present disclosure is directed to exemplary methods and devices for production of metal matrix nanocomposites that enable an effective dispersion of nanoparticles within the metal matrix. Metal matrix nanocomposites that may be produced by utilizing the exemplary methods and devices may be composite materials that include nanoparticles that are dispersed within a metal matrix. In exemplary embodiments, nanoparticles made of ceramics, carbides, nitrides, oxides, etc., may be dispersed in metal matrices made of aluminum, magnesium, nickel, copper, and their alloys.

Exemplary devices may include a dispersion mechanism in which nanoparticles are thoroughly dispersed into an inert gas stream in a dispersion chamber that may be equipped with an impeller to suspend and disperse the nanoparticles into the inert gas. The obtained dispersion of nanoparticles may then be injected into and mechanically mixed with a volume of molten metal. Thus, the exemplary methods may include the steps of obtaining a nanodispersion by dispersing the nanoparticles into an inert gas stream, injecting the nanodispersion into the volume of molten metal with a controlled rate, and obtaining a molten mixture by mixing the injected nanodispersion in the volume of molten metal.

In an exemplary embodiment, controlled injection of suspended nanoparticles utilizing an inert gas stream allows for enhancing the wettability and uniform distribution of nanoparticles within the metal matrix, which in turn may lead to an increase in the uniformity of microstructures and improvement of mechanical properties of the final metal matrix nanocomposite. Furthermore, the dispersion mechanisms utilized in exemplary devices may prevent formation of nanoparticle agglomerates within the stream of inert gas and, as a result, in later stages, prevent formation of nanoparticle agglomerates within the molten metal matrix.

FIG. 1A illustrates a method 100 for producing metal matrix nanocomposites, consistent with one or more exemplary embodiments of the present disclosure. Method 100 may include a step 102 of obtaining a nanodispersion by dispersing a plurality of nanoparticles into an inert gas; a step 104 of injecting the nanodispersion into a volume of molten metal; a step 106 of obtaining a molten mixture by mechanically mixing the nanodispersion with the volume of molten metal; and a step 108 of applying a casting process on the molten mixture by transferring the molten mixture into a die.

Figure 1B:
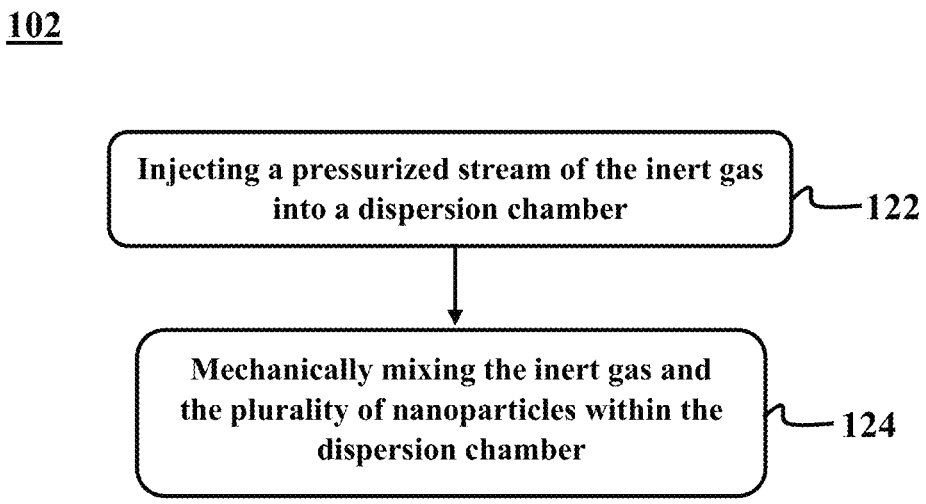
FIG. 1B is a flow chart of a method for dispersing a plurality of nanoparticles into an inert gas, consistent with one or more exemplary embodiments of the present disclosure.

FIG. 1B is a flow chart of a method for dispersing a plurality of nanoparticles into an inert gas, consistent with one or more exemplary embodiments of the present disclosure. FIG. 1B illustrates details of step 102 of FIG. 1A. Referring to FIG. 1B, consistent with one or more exemplary embodiments, step 102 of obtaining a nanodispersion by dispersing a plurality of nanoparticles into an inert gas may include a step 122 of injecting a pressurized stream of the inert gas into a dispersion chamber and a step 124 of mechanically mixing the inert gas and the plurality of nanoparticles within the dispersion chamber.

Figure 2A:
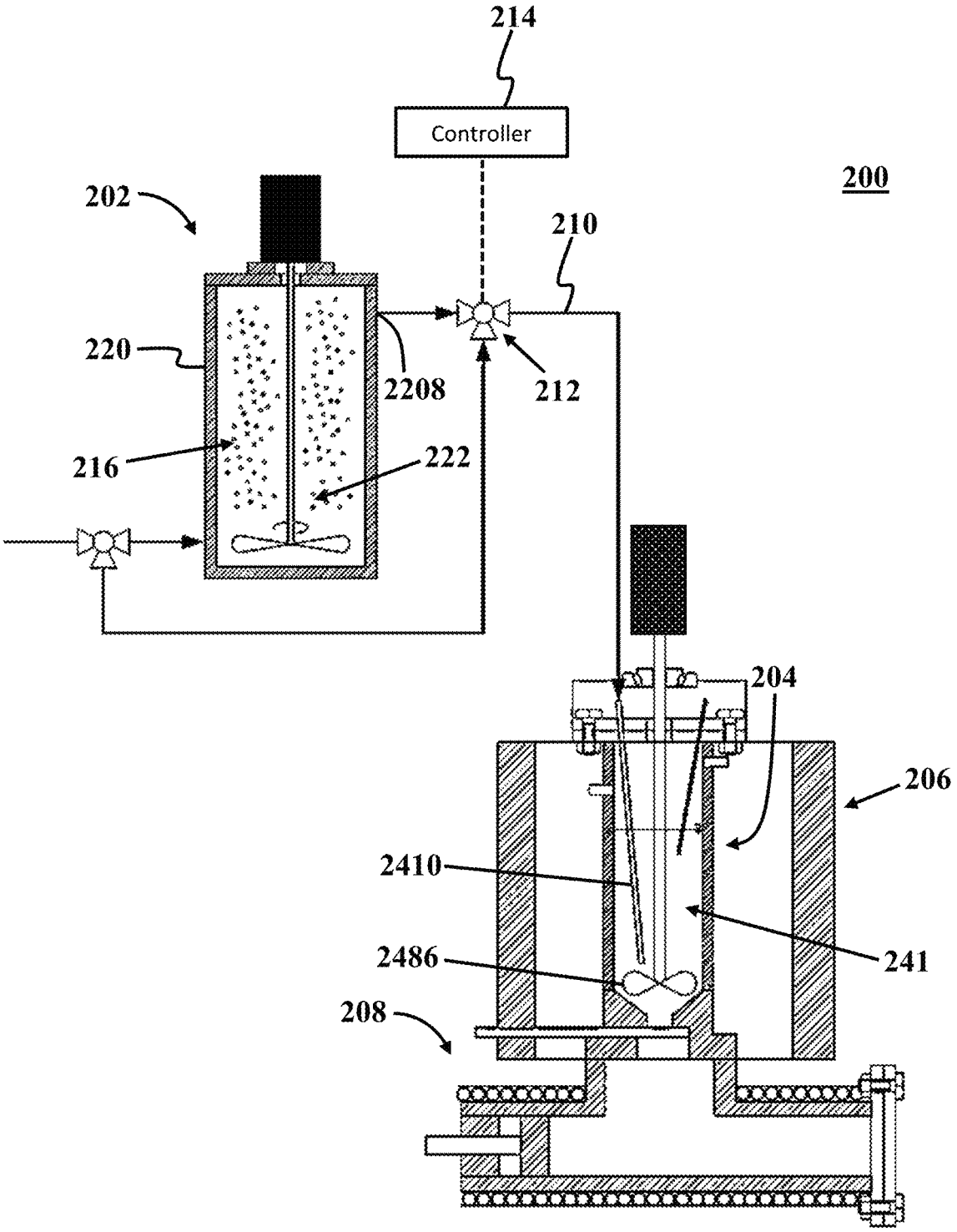
FIG. 2A illustrates an apparatus for producing metal matrix nanocomposites, consistent with one or more exemplary embodiments of the present disclosure.

FIG. 2A illustrates an apparatus 200 for producing metal matrix nanocomposites, consistent with one or more exemplary embodiments of the present disclosure. Apparatus 200 may include a dispersion mechanism 202 configured to disperse a plurality of nanoparticles into an inert gas; an air-tight crucible 204 that may be enclosed and heated by a furnace 206; and a die-casting mechanism 208 configured to apply a die casting process on a molten mixture. In an exemplary embodiment, apparatus 200 may be utilized for implementing method 100 of FIG. 1A.

Referring to FIG. 2A, in an exemplary embodiment, dispersion mechanism 202 may include an air-tight cylindrical dispersion chamber 220 and a first mechanical mixer 222 that may be disposed within the air-tight cylindrical chamber 220.

Figure 2B:
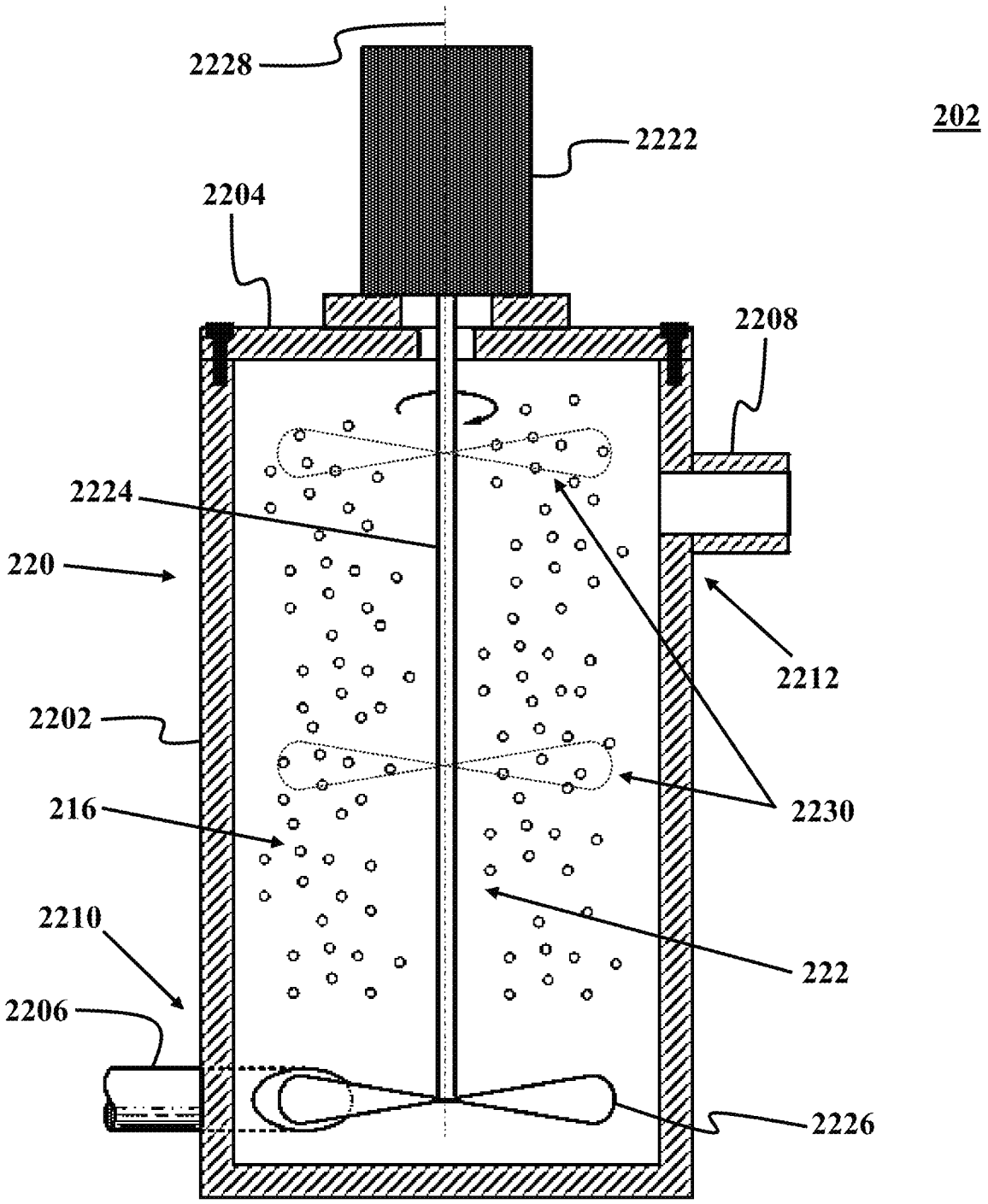
FIG. 2B illustrates a sectional side-view of a dispersion mechanism, consistent with one or more exemplary embodiments.

FIG. 2B illustrates a sectional side-view of dispersion mechanism 202, consistent with one or more exemplary embodiments. Referring to FIG. 2B, in an exemplary embodiment, air-tight cylindrical dispersion chamber 220 may include a main body 2202, an upper end cap 2204, an inlet port 2206, and a discharge port 2208. In an exemplary embodiment, main body 2202 may be a cylindrical chamber with an upper opening that may be sealed by upper end cap 2204. In an exemplary embodiment, inlet port 2206 may be connected in fluid communication with a lower portion 2210 of main body 2202 and discharge port 2208 may be connected in fluid communication with an upper portion 2212 of main body 2202 bellow upper end cap 2204.

Figure 2C:
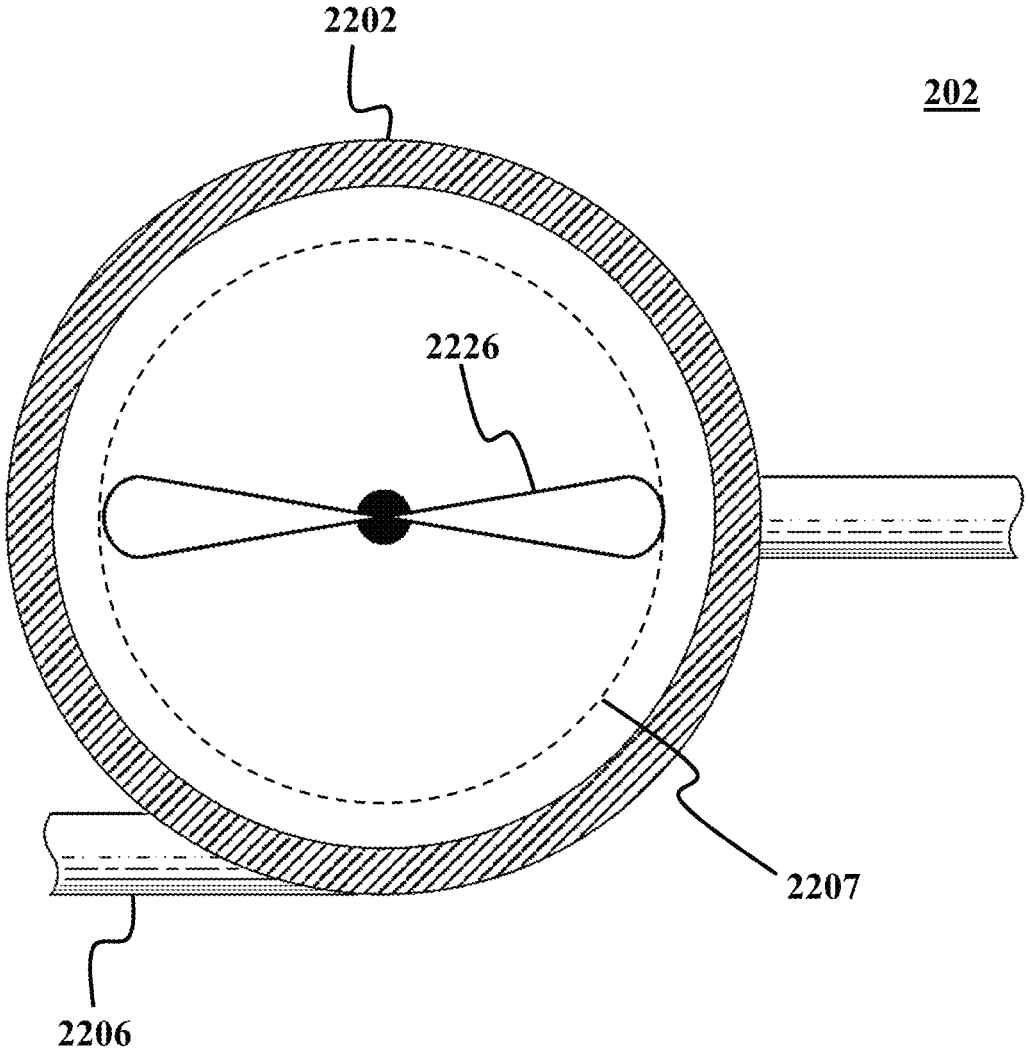
FIG. 2C illustrates a sectional top-view of dispersion mechanism, consistent with one or more exemplary embodiments.

FIG. 2C illustrates a sectional top-view of dispersion mechanism 202, consistent with one or more exemplary embodiments. Referring to FIG. 2C, in an exemplary embodiment, inlet port 2206 may be tangentially connected in fluid communication with lower portion of main body 2202. Such a configuration may allow for injecting a pressurized stream of an inert gas tangential to an inner circular circumference of main body 2202. In an exemplary embodiment, the injected inert gas may assume a circular motion path within main body 2202 due to being injected into main body 2202 in a path tangential to the inner circular circumference of main body 2202.

Referring to FIG. 2B, in an exemplary embodiment, first mechanical mixer 222 may include a first mechanical actuator 2222 such as a rotary motor, a first impeller shaft 2224 that may be coupled with the first mechanical actuator 2222, and at least one axial-flow impeller 2226 that may be mounted on the first impeller shaft 2224. First mechanical actuator 2222 and first impeller shaft 2224 may be configured to drive a rotational movement of at least one axial-flow impeller 2226 about a longitudinal axis 2228 of first impeller shaft 2224. In an exemplary embodiment, first mechanical mixer 222 may further include several axial-flow impellers 2230 that may be mounted on first impeller shaft 2224 at different heights within main body 2202. Such a configuration may increase the mixing efficiency of first mechanical mixer 222 due to an increase in capability of first mechanical mixer 222 in creating an axial flow within main body 2202 to more effectively disperse the nanoparticles into the inert gas.

Referring to FIG. 2A, consistent with one or more exemplary embodiments, air-tight crucible 204 may be enclosed within furnace 206. In an exemplary embodiment, metal matrix materials may be poured into air-tight crucible 204. Air-tight crucible 204 may be heated by furnace 206 to a melting temperature of the metal matrix materials in order to obtain a volume of molten metal 241 within air-tight crucible 204.

Figure 2D:
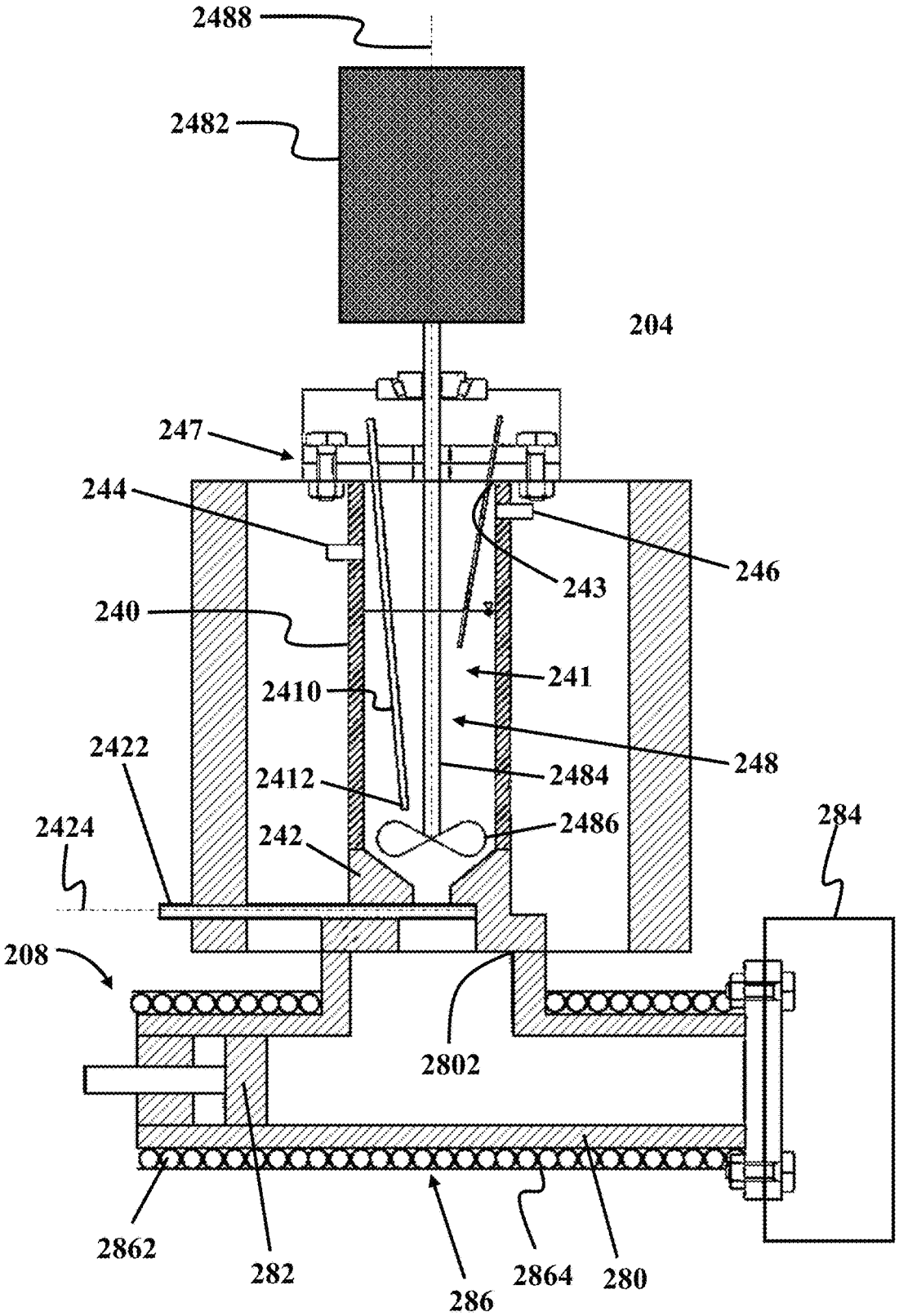
FIG. 2D illustrates a sectional side-view of an air-tight crucible and a die-casting mechanism, consistent with one or more exemplary embodiments.

FIG. 2D illustrates a sectional side-view of air-tight crucible 204 and die-casting mechanism 208, consistent with one or more exemplary embodiments. In an exemplary embodiment, air-tight crucible 204 may include a crucible body 240, a molten metal discharge section 242, a gas inlet port 244, a gas outlet port 246, and a crucible cap 247. In an exemplary embodiment, crucible body 240 may have an upper opening 243 that may be utilized for loading the metal matrix materials into air-tight crucible 204. Crucible cap 247 may tightly seal upper opening 243 of crucible body 240, once the metal matrix materials are loaded into air-tight crucible 204. An inert gas stream, such as an argon stream may be injected into crucible body 240 via gas inlet port 244 and be discharged out of crucible body 240 via gas outlet port 246 during melting process within air-tight crucible 204. In an exemplary embodiment, crucible body 240 may be attached to molten metal discharge section 242 which may be a cone-shaped conduit intercepted by a gate valve 2422. In an exemplary embodiment, a discharge flow of molten metal out of air-tight crucible 204 may be controlled by gate valve 2422. Gate vale 2422 may be opened and closed by sliding gate valve 2422 back and forth along axis 2424.

In an exemplary embodiment, air-tight crucible 204 may further be equipped with a second mechanical mixer 248 that may be configured to mechanically mix the molten contents of air-tight crucible 204. In an exemplary embodiment, second mechanical mixer 248 may include a second mechanical actuator 2482 such as a rotary motor, a second impeller shaft 2484 that may be coupled with the second mechanical actuator 2482, and an impeller 2486 that may be mounted on the second impeller shaft 2484. Second mechanical actuator 2482 and second impeller shaft 2484 may be configured to drive a rotational movement of impeller 2486 about a longitudinal axis 2488 of second impeller shaft 2484. In an exemplary embodiment, impeller 2486 may be dipped into volume of molten metal 241 within air-tight crucible 204 and may be configured to mechanically mix volume of molten metal 241.

Referring to FIGS. 2A and 2D, in an exemplary embodiment, an injection probe 2410 may be partially inserted into air-tight crucible 204. Injection probe 2410 may provide fluid communication between discharge port 2208 of dispersion mechanism 202 and air-tight crucible 204 such that contents of air-tight cylindrical dispersion chamber 220 may be controllably injected into volume of molten metal 241 within air-tight crucible 204. In an exemplary embodiment, an injection tip 2412 of injection probe 2410 may be positioned immediately above impeller 2486 within volume of molten metal 241. In an exemplary embodiment, injection probe 2410 may be in fluid communication with discharge port 2208 of dispersion mechanism 202 via injection line 210. Injection line 210 may be intercepted by an injection valve 212 that may be functionally coupled with a controller 214. In an exemplary embodiment, controller 214 may be configured to control the flow rate within injection line 210.

Referring to FIG. 2D, in an exemplary embodiment, die-casting mechanism 208 may include a pumping chamber 280 that may be in fluid communication with air-tight crucible 204 for selectively receiving molten contents of air-tight crucible 204. Die-casting mechanism 208 may further include a ram 282 that may be movably disposed within pumping chamber 208. In an exemplary embodiment, die-casting mechanism 208 may further include a die 284 that may be attached to pumping chamber 280 such that ram 282 may be adapted to direct the received molten content within pumping chamber 280 into an opening of die 284 for casting the molten content into desired parts. In an exemplary embodiment, ram 282 may be configured to direct the molten mixture into the opening of die 284 by traveling within pumping chamber 280, upon actuation by an actuator, from a first position upstream of upper opening 2802 to a second position downstream of upper opening 2802 adjacent die 284.

In an exemplary embodiment, die-casting mechanism 208 may further include a heating system 286 that may keep an inner temperature of pumping chamber 280 high in order to prevent the molten content to cool down and clog pumping chamber 280. In an exemplary embodiment, heating system 286 may include a heating coil 2862 that may encompass pumping chamber 280. Heating system 286 may further include an insulating layer 2864 that may enclose heating coil 2862 and pumping chamber 280 and may prevent heat loss to the environment.

In an exemplary embodiment, pumping chamber 280 may include an upper opening 2802 immediately below molten metal discharge section 242 such that opening gate valve 2422 may allow the molten content of air-tight crucible 204 to pour down into pumping chamber 280.

FIGS. 1A and 1B in combination with FIGS. 2A-2D illustrate the functionality in light of structure of apparatus 200, consistent with one or more exemplary embodiments of the present disclosure. Step 102 may include step 122 of obtaining a nanodispersion by dispersing a plurality of nanoparticles into an inert gas by injecting a pressurized stream of the inert gas into a dispersion chamber and step 124 of mechanically mixing the inert gas and the plurality of nanoparticles within the dispersion chamber. For example, the plurality of nanoparticles may be poured into main body 2202 and after sealing main body 2202 by upper end cap 2204, the pressurized stream of the inert gas may be injected into air-tight cylindrical dispersion chamber 220. First mechanical mixer 222 may be utilized for mechanically mixing the inert gas and the plurality of nanoparticles. First mechanical actuator 2222 and first impeller shaft 2224 may drive a rotational movement of at least one axial-flow impeller 2226. Axial flow impeller 226 may be configured to efficiently mix the inert gas and the plurality of nanoparticles by creating an axial flow within air-tight cylindrical dispersion chamber 220.

In an exemplary embodiment, step 122 may include injecting the pressurized stream of the inert gas into a cylindrical dispersion chamber through a tangential inlet port connected in fluid communication to the cylindrical dispersion chamber. For example, the pressurized stream of the inert gas may be injected into air-tight cylindrical dispersion chamber 220 via tangential inlet port 2206. In an exemplary embodiment, the pressurized inert gas may be injected into air-tight cylindrical dispersion chamber 220 via tangential inlet port 2206 such that the pressurized stream of the inert gas may be injected tangential to a trailing-edge circle 2207 of the axial-flow impeller 2226. In an exemplary embodiment, injecting the inert gas tangential to the trailing-edge circle 2207 may urge the injected pressurized inert gas to assume a circular motion path within air-tight cylindrical dispersion chamber 220. This circular motion of the injected pressurized inert gas in combination with the axial flow created by axial-flow impeller 2226 may enable an efficient dispersion of nanoparticles into the inert gas and obtaining a stable and uniform nanodispersion 216 utilizing dispersion mechanism 202.

Referring to FIG. 1A and FIG. 2A, in an exemplary embodiment, step 104 may include injecting the nanodispersion into a volume of molten metal. For example, nanodispersion 216 that may be formed by utilizing dispersion mechanism 202 may be injected into volume of molten metal 241 within air-tight crucible 204 via injection probe 2410. In an exemplary embodiment, injection probe 2410 may be in fluid communication with discharge port 2208 of dispersion mechanism 202 via injection line 210. In an exemplary embodiment, injection valve 212 may be opened and pressurized nanodispersion 216 within air-tight cylindrical dispersion chamber 220 may be injected through injection line 210 into injection probe 2410.

Referring to FIG. 1A and FIG. 2A, in an exemplary embodiment, step 106 may include obtaining a molten mixture by mechanically mixing the nanodispersion with the volume of molten metal. In an exemplary embodiment, injection probe 2410 may inject pressurized nanodispersion 216 into volume of molten metal 241 immediately above impeller 2486. Second mechanical actuator 2482 and second impeller shaft 2484 may drive a rotational movement of impeller 2486 about longitudinal axis 2488 of second impeller shaft 2484 and impeller 2486 may be configured to mechanically mix the injected nanodispersion into volume of molten metal 241. In an exemplary embodiment, injecting pressurized nanodispersion 216 into volume of molten metal 241 immediately above impeller 2486 may allow for a more effective mechanical mixing of the injected nanodispersion into volume of molten metal 241 and obtaining a more uniform molten mixture within air-tight crucible 204.

Referring to FIG. 1A and FIG. 2D, in an exemplary embodiment, step 108 may include applying a casting process on the molten mixture by transferring the molten mixture into a die. For example, once the molten mixture is obtained within air-tight crucible 204, gate vale 2422 may be opened and the molten mixture may be discharged through molten metal discharge section 242 into chamber 280 via upper opening 2802. In an exemplary embodiment, at this stage, ram 282 may be driven forward to direct the molten mixture within pumping chamber 280 toward the opening of die 284.

Example 1

In this example, Al2024-$TiO_2$ metal matrix nanocomposites with three volume percentages of 0.5, 1, and 1.5 (vol. % of nanoparticles in metal matrix nanocomposite) were produced by an exemplary method, consistent with one or more exemplary embodiments of the present disclosure. $TiO_2$ nanoparticles were injected into molten metal using argon inert gas. Porosity, microstructural properties, mechanical properties and wear resistance of the as-prepared metal matrix nanocomposites were investigated.

Al2024 alloy was used as the metal matrix. Table 1 reports the chemical composition of the Al2024 alloy. The spherical $TiO_2$ nanoparticles with an average diameter of approximately 20 nm were used as reinforcing particles.

TABLE 1

Chemical composition of Al2024 alloy.

| | Element | | | | | |
|---|---|---|---|---|---|---|
| | Al | Mg | Si | Fe | Cu | Mn |
| Weight Percent | 93.6 | 1.4 | 0.06 | 0.21 | 4.1 | 0.37 |

A stir casting process similar to method 100 of FIG. 1 was carried out utilizing an exemplary apparatus similar to apparatus 200 of FIG. 2A for manufacturing Al2024-$TiO_2$ nanocomposites. $TiO_2$ nanoparticles were added to the metal matrix in three different volume percentages of 0.5, 1 and 1.5. After dispersing the $TiO_2$ nanoparticles into a stream of argon and obtaining a $TiO_2$ nanodispersion, the $TiO_2$ nanodispersion was injected into a volume of molten aluminum. Aluminum melt was kept at a temperature of approximately 720° C. during injection of $TiO_2$ nanodispersion. While $TiO_2$ nanodispersion was being injected into the volume of molten aluminum, the molten aluminum was stirred at 500 rpm. Thereafter, the molten mixture was poured into a steel mold to form three sample ingots.

In order to investigate the microstructural properties, several cross-sections were cut from the sample ingots. These cross-sections were mechanically polished and etched with Keller's reagent. Then, an optical microscope and a scanning electron microscope (SEM) that was equipped with an energy-dispersive X-ray spectroscope (EDS) were used to investigate the microstructure and distribution of $TiO_2$ nanoparticles in the sample ingots. Sample porosity was measured using the theoretical density of each sample ingot and empirical density of each sample ingot. Mechanical properties of the sample ingots were measured using tensile test at room temperature with the speed of approximately 1 mm/min. The Rockwell B-scale hardness (HRB) of the sample ingots was determined using a 1.588 mm diameter spherical steel indenter with 10 kg and 100 Kg force for minor and major loads, respectively. Wear tests were performed under dry conditions using a pin-on-disk tester. The diameter of the pin was 3 mm with hardness of 60 HRC and the diameter of the disk was 30 mm. All sample ingots were polished before the tests to have the same roughness. Wear tests were performed for the distance of 600 meters using a force of 5N with a speed of 0.13 m/s.

The theoretical densities of the sample ingots were calculated using the rule of mixture and density of 2.78 g/cm$^3$ for Al2024 and 4.32 g/cm$^3$ for $TiO_2$ nanoparticles. The empirical density of the fabricated sample ingots was calculated using Archimedes method. Porosities of the sample ingots were calculated using Equation (1) below:

$$\text{Porosity} = \frac{\text{Theoritical density} - \text{Experimental density}}{\text{Theoritical density}} \quad \text{Equation (1)}$$

Table 2 reports the values of theoretical density, relative density and porosity of the nanocomposites. Referring to Table 2, theoretical and empirical density increase with increasing the volume fraction of reinforcing nanoparticles. This might be due to the fact that $TiO_2$ nanoparticles have a higher density compared to Al2024 matrix. Increasing the nanoparticle content may also lead to an increase in the porosity of the sample ingots. This increase in the porosity may be due to the presence of voids in clusters that may trap gas bubbles during stir casting process. With an increase in the volume fraction of $TiO_2$ nanoparticles, viscosity of molten metal increases and therefore the removal rate of trapped gas during solidification decreases. Agglomeration of nanoparticles is a reason for the increase in porosity. This agglomeration is more at higher nanoparticle contents.

TABLE 2

Porosity test results for different sample ingots.

| Material | Theoretical density ($gcm^{-3}$) | Experimental density ($gcm^{-3}$) | Relative density (%) | Porosity (%) |
|---|---|---|---|---|
| Al2024 | 2.780 | 2.758 | 0.992 | 0.779 |
| Al2024-0.5% $TiO_2$ | 2.787 | 2.764 | 0.991 | 0.806 |
| Al2024-1.0% $TiO_2$ | 2.794 | 2.767 | 0.990 | 0.980 |
| Al2024-1.5% $TiO_2$ | 2.801 | 2.770 | 0.988 | 1.120 |

Figure 3:
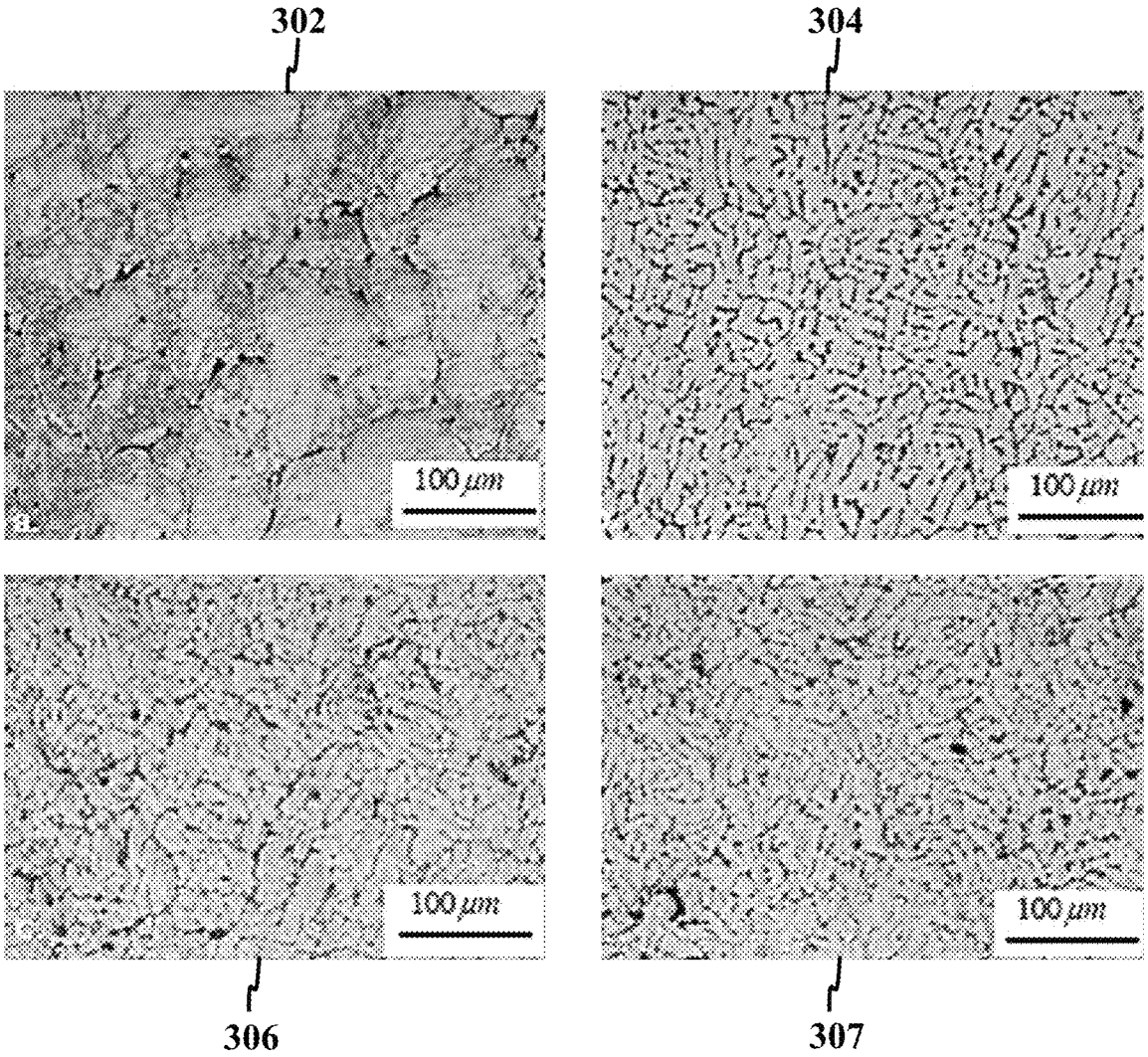
FIG. 3 shows metallography images of Al2024, Al2024-0.5% $TiO_2$, Al2024-1.0% $TiO_2$, and Al2024-1.5% $TiO_2$, consistent with one or more exemplary embodiments of the present disclosure.

FIG. 3 shows metallography images of Al2024 (302), Al2024-0.5% $TiO_2$ (304), Al2024-1.0% $TiO_2$ (306), and Al2024-1.5% $TiO_2$ (308), consistent with one or more exemplary embodiments of the present disclosure. As apparent, the dendritic size of Al2024 alloy may reduce with increasing the volume fraction of $TiO_2$ nanoparticles. $TiO_2$ nanoparticles may provide high-energy interfaces that may be favorable for nucleation of new grains. $TiO_2$ nanoparticles that are located at grain boundaries may further create a pinning effect, which prevents a growth in grain size.

Figure 4:
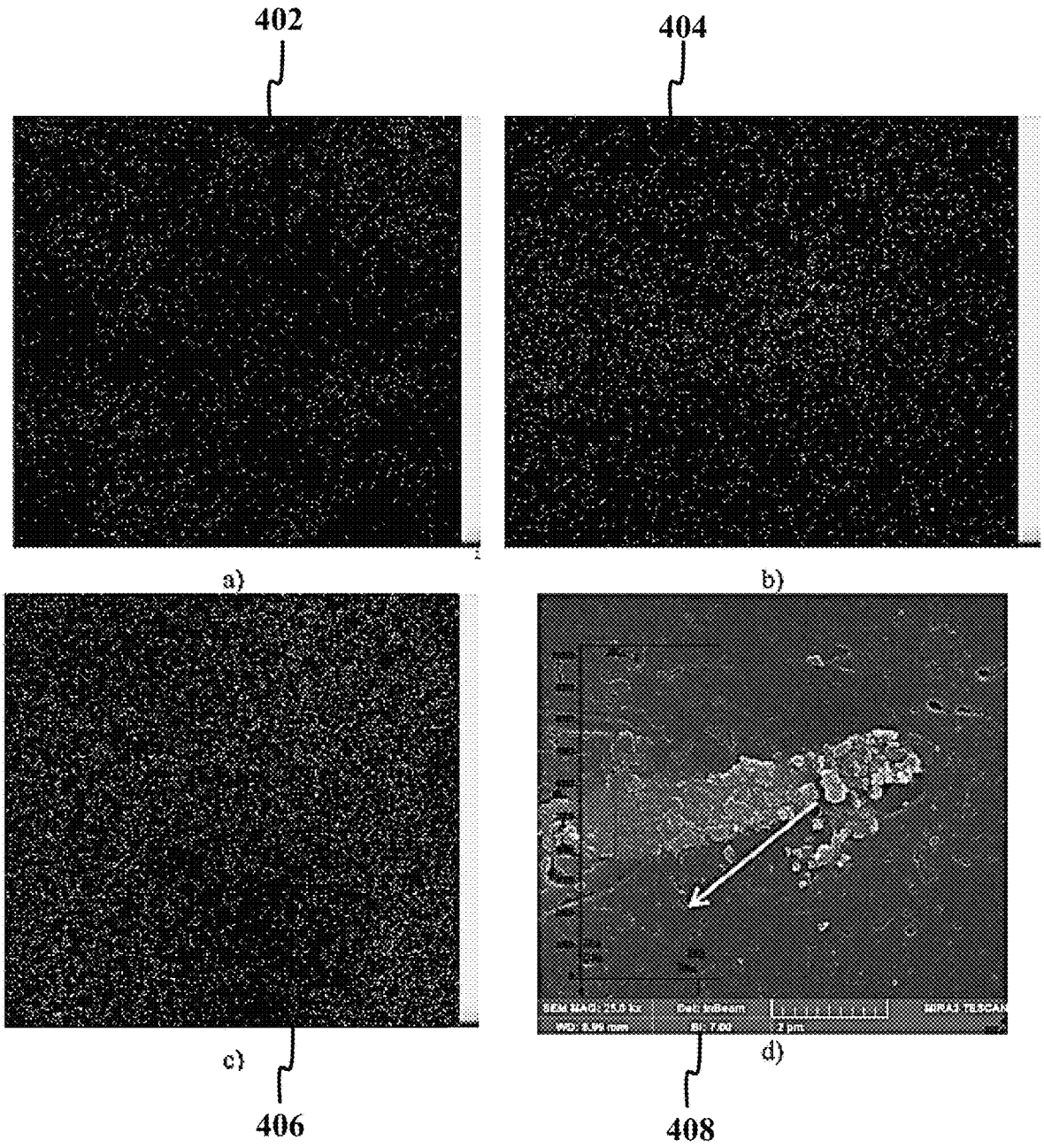
FIG. 4 shows map images of Al2024-0.5% $TiO_2$, Al2024-1.0% $TiO_2$, Al2024-1.5% $TiO_2$, and agglomerated $TiO_2$ nanoparticles, consistent with an exemplary embodiment of the present disclosure.

FIG. 4 shows map images of Al2024-0.5% $TiO_2$ (402), Al2024-1.0% $TiO_2$ (404), Al2024-1.5% $TiO_2$ (406), and agglomerated $TiO_2$ nanoparticles (408), consistent with one or more exemplary embodiments of the present disclosure. As apparent, the distribution of $TiO_2$ nanoparticles may be almost uniform in Al2024-0.5% $TiO_2$, Al2024-1.0% $TiO_2$, Al2024-1.5% $TiO_2$ nanocomposites as evident by map images 402-406. One of the reasons for uniform distribution of nanoparticles even at high volume fractions may be the increase in their wettability due to controlled injection using a dispersion mechanism similar to dispersion mechanism 202 of FIG. 2A, in which according to method 100 of FIG. 1, a $TiO_2$ nanodispersion may be obtained by dispersing $TiO_2$ nanoparticles into argon. In exemplary embodiments, utilizing a dispersion mechanism similar to dispersion mechanism 202 may allow for minimizing agglomeration of nanoparticles in the metal matrix.

Figure 5A:
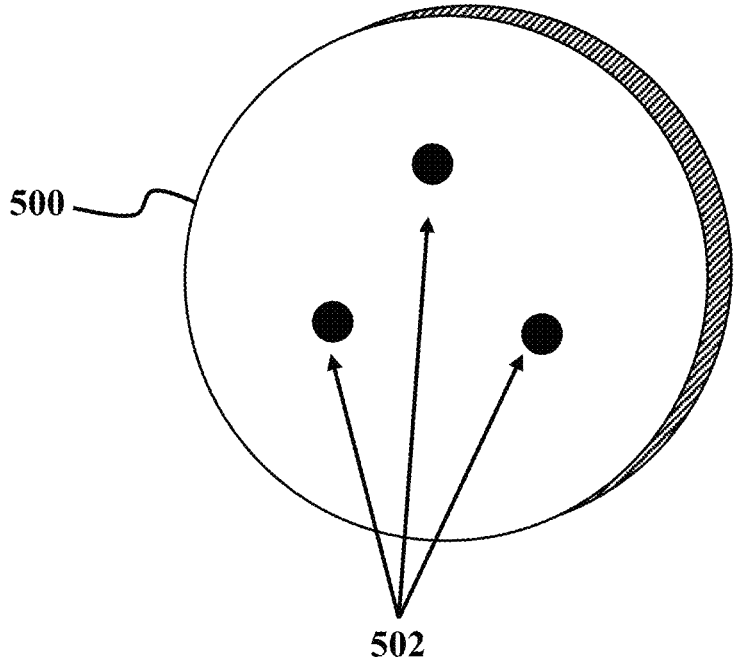
FIG. 5A illustrates a cross-section of a sample ingot, consistent with one or more exemplary embodiments of the present disclosure.

FIG. 5A illustrates a cross-section 500 of a sample ingot, consistent with one or more exemplary embodiments of the present disclosure. In order to determine the micro hardness of the sample ingots, a cross-section of each sample was prepared similar to cross-section 500 and micro harness of each sample was tested at three different locations on the cross-section of each sample, as shown by black circles 502. After that an average micro hardness was obtained for each sample ingot.

Figure 5B:
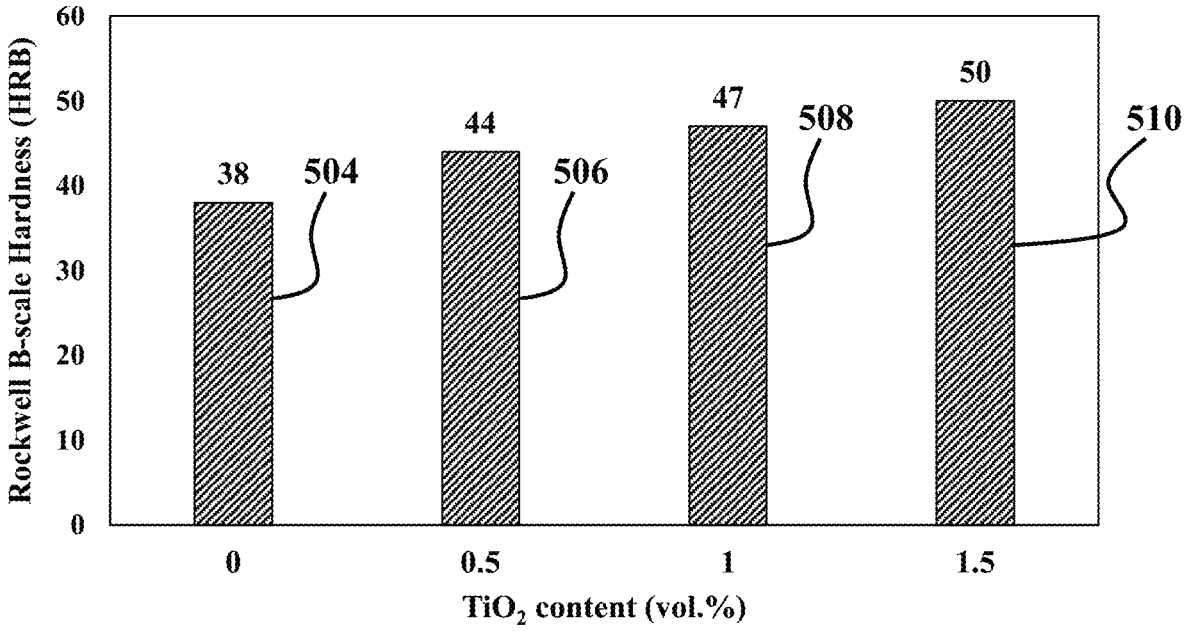
FIG. 5B shows an average measured Rockwell B-scale hardness for Al2024, Al2024-0.5% $TiO_2$, Al2024-1.0% $TiO_2$, and Al2024-1.5% $TiO_2$, consistent with one or more exemplary embodiments of the present disclosure.

FIG. 5B shows an average measured Rockwell B-scale hardness for Al2024 (504), Al2024-0.5% $TiO_2$ (506), Al2024-1.0% $TiO_2$ (508), and Al2024-1.5% $TiO_2$ (510), consistent with one or more exemplary embodiments of the present disclosure. Referring to FIG. 5B, the results of hardness test appear to indicate that with an increase in volume fraction of $TiO_2$ nanoparticles, the hardness of the sample ingots increases. Nanocomposites with $TiO_2$ volume fractions of 0.5, 1 and 1.5% show 15.78%, 23.68% and 31.57% increase in hardness compared to unreinforced sample, respectively. The first reason for this increase in hardness is due to uniform distribution of nanoparticles. The hardness of a ductile matrix increases due to incorporation of hard reinforcement materials. $TiO_2$ nanoparticles have higher hardness compared to Al2024 matrix and therefore they may increase the resistance of nanocomposites against plastic deformations. Furthermore, an increase in the nanoparticle content of the nanocomposite decreases the dendritic sizes, which may result in an increase in micro hardness.

Figure 6:
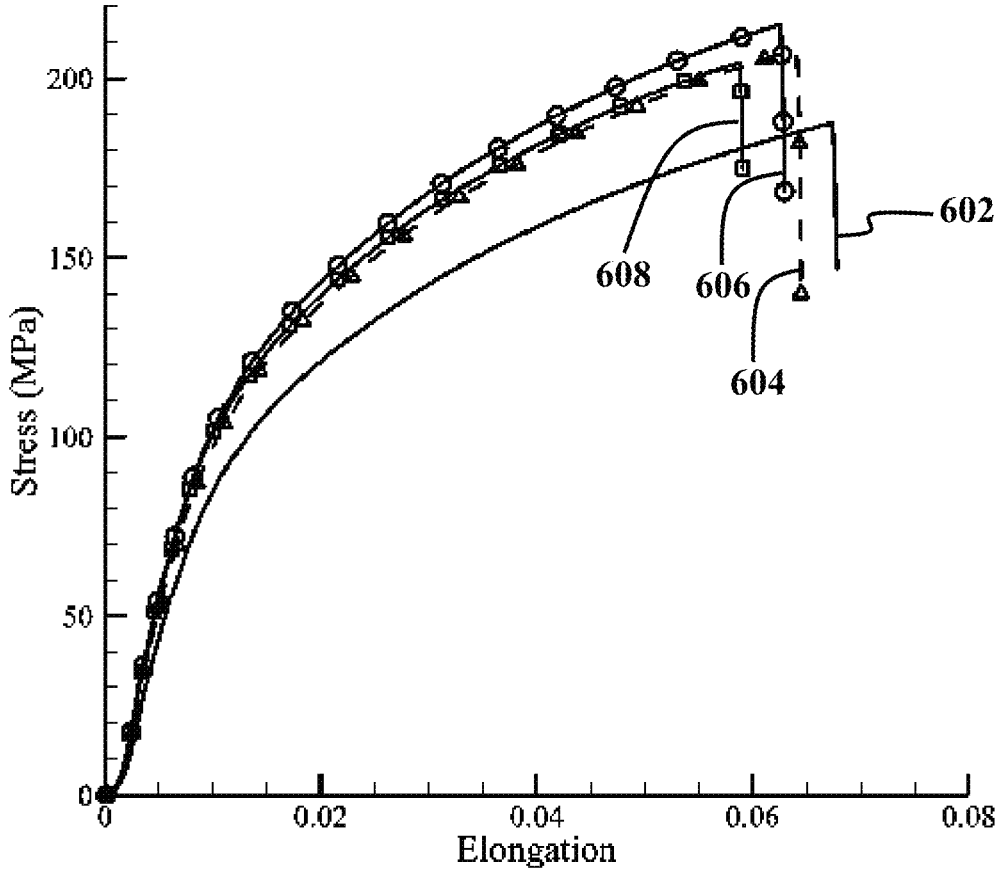
FIG. 6 illustrate stress-strain curves for Al2024, Al2024-0.5% $TiO_2$, Al2024-1.0% $TiO_2$, and Al2024-1.5% $TiO_2$, consistent with one or more exemplary embodiments of the present disclosure.

FIG. 6 illustrate stress-strain curves for Al2024 (602), Al2024-0.5% $TiO_2$ (604), Al2024-1.0% $TiO_2$ (606), and Al2024-1.5% $TiO_2$ (608), consistent with one or more exemplary embodiments of the present disclosure. Referring to FIG. 6, with an increase in nanoparticle content of nanocomposites, ultimate stress increases while sample elongation decreases. Adding reinforcing nanoparticles may cause an increase in ultimate stress compared to unreinforced sample. At 1% volume fraction of nanoparticles, the ultimate stress was 14.6% higher than that of the unreinforced sample while it was 6.6% higher than that of the unreinforced sample at 1.5% volume fraction of nanoparticles. Sample elongation decreased with an increase in nanoparticle content, the sample containing 1.5% nanoparticles showed 13.8% less elongation compared to unreinforced sample. Increasing the volume percentage of nanoparticles leads to an increase in the porosity of the samples. Furthermore, increasing the volume percentage of nanoparticles leads to an increase in the probability of agglomeration of nanoparticles in samples.

Figure 7:
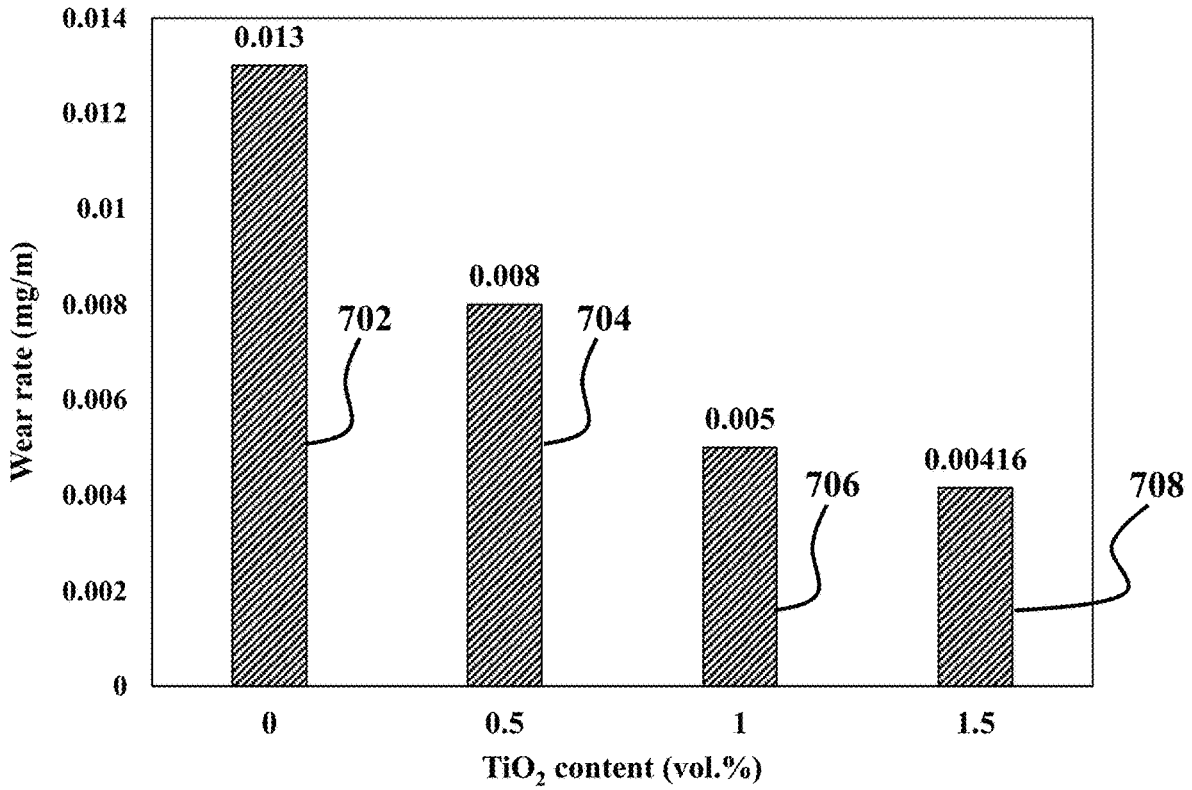
FIG. 7 illustrates variations of wear rate versus $TiO_2$ content for Al2024, Al2024-0.5% $TiO_2$, Al2024-1.0% $TiO_2$, and Al2024-1.5% $TiO_2$, consistent with one or more exemplary embodiments of the present disclosure.

FIG. 7 illustrates variations of wear rate versus $TiO_2$ content for Al2024 (702), Al2024-0.5% $TiO_2$ (704), Al2024-1.0% $TiO_2$ (706), and Al2024-1.5% $TiO_2$ (708), consistent with one or more exemplary embodiments of the present disclosure. Referring to FIG. 7, for a force of 5N and distance of 600 meters, the wear rate of 0.013 for unreinforced sample has decreased to 0.00416 mg $m^{-1}$ for sample with 1.5% $TiO_2$ nanoparticle content. The results appear to indicate the addition of $TiO_2$ nanoparticles has a significant effect on reducing the wear rate of the samples.

Figure 8A:
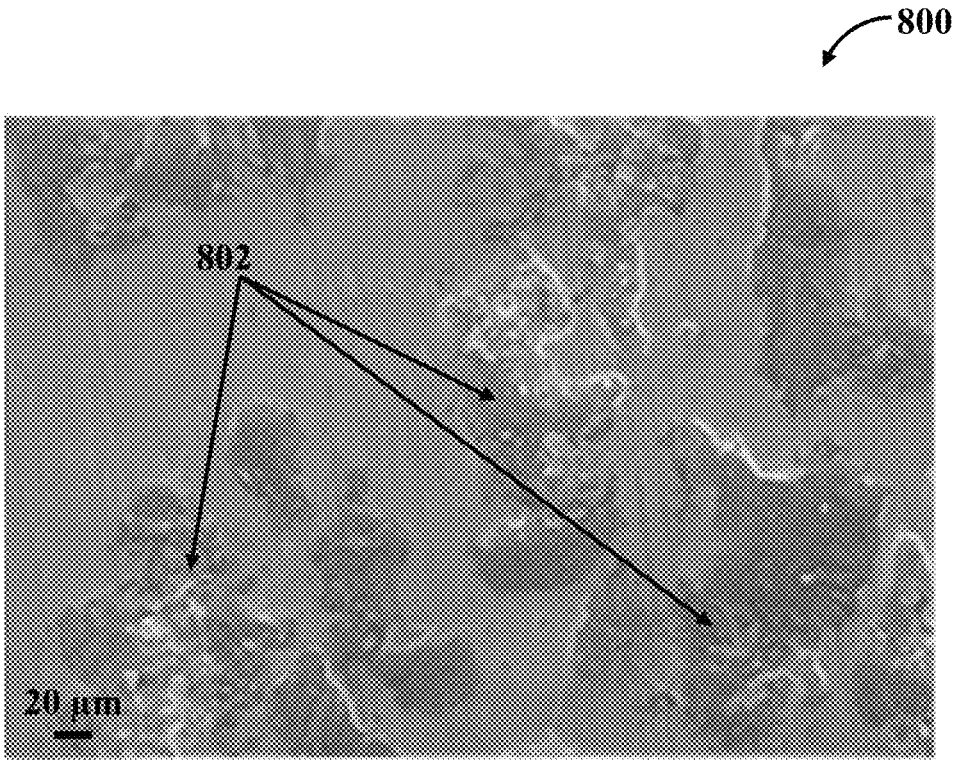
FIG. 8A is an SEM image of a worn surface of the unreinforced sample (Al2024), consistent with an exemplary embodiment of the present disclosure.
Figure 8B:
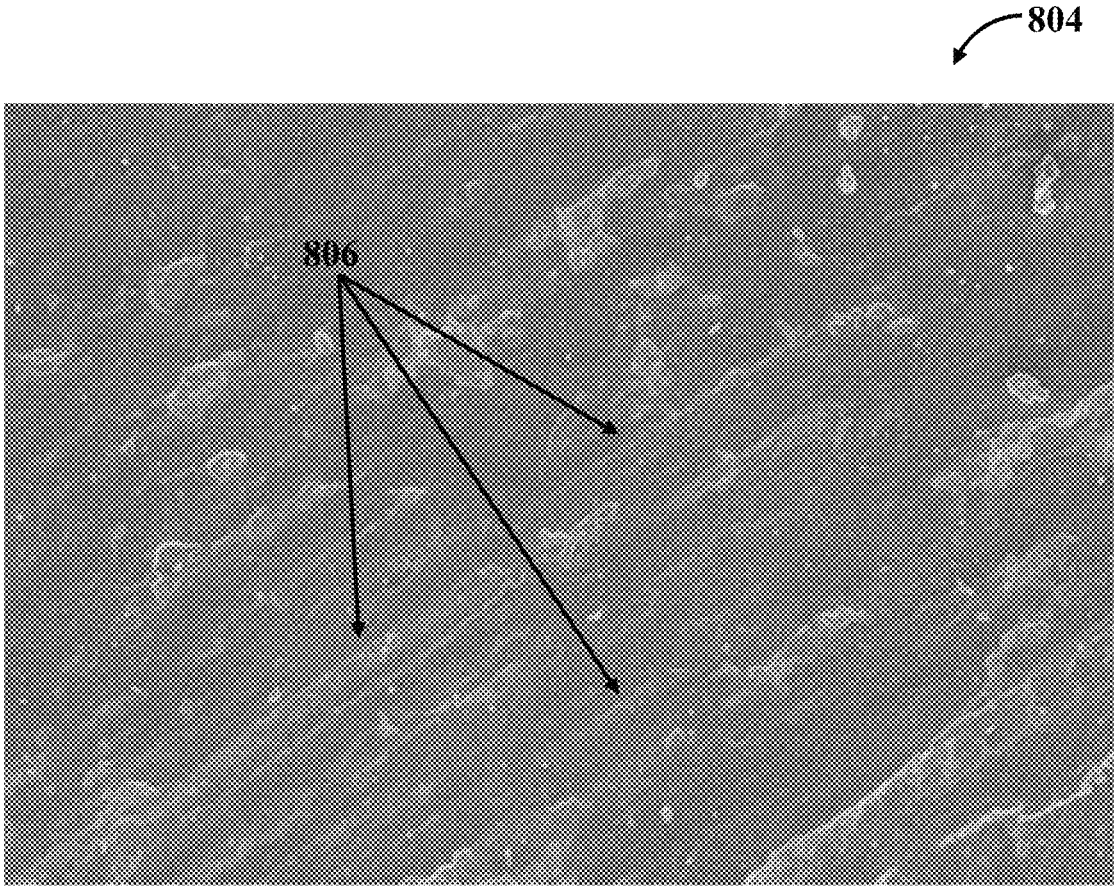
FIG. 8B is an SEM image of a worn surface of Al2024-1.5% $TiO_2$ sample, consistent with an exemplary embodiment of the present disclosure.

FIG. 8A is an SEM image 800 of a worn surface of the unreinforced sample (Al2024), consistent with one or more exemplary embodiments t of the present disclosure. FIG. 8B is an SEM image 804 of a worn surface of Al2024-1.5% $TiO_2$ sample, consistent with one or more exemplary embodiments of the present disclosure. Referring to FIG. 8A, some craters 802 are visible on the surface of the unreinforced sample (Al2024) that may indicate an adhesive wear mechanism. Referring to FIG. 8B, some narrow grooves 806 are visible on the surface of Al2024-1.5% $TiO_2$ sample. It appears that with an increase in nanoparticle content of the samples from 0.5% to 1.5% volume fraction, the effects of abrasive wear mechanism increases while the effects of adhesive mechanism decreases. This may be due to the presence of $TiO_2$ nanoparticles. Hard reinforcing nanoparticles reduce the flow of materials during wear. $TiO_2$ nanoparticles also act as abrasive particles and create narrow grooves 806 on the worn surface. Surface hardening and protruded nanoparticles control the penetration depth of the pin. Nanoparticles may help prevent severe plastic deformation of the surface and therefore reduce the mass reduction rate.

Furthermore, SEM image 800 shows that the worn surface of the unreinforced sample (Al2024) is rough and SEM image 804 show that the worn surface of Al2024-1.5% $TiO_2$ sample is smooth due to proper bonding between nanoparticles and metal matrix.

Example 2

In this example, AZ31-SiC nanocomposites were fabricated by an exemplary squeeze stir casting method, consistent with one or more exemplary embodiments of the present disclosure. SiC nanoparticles were injected into molten metal using argon inert gas. Effect of different stirring and cooling rates along with microstructure and mechanical properties of different nanocomposite samples are investigated. AZ31 alloy with a chemical composition reported in Table 3 is used as the starting material and SiC nanoparticles with an average size of 50 nm and a purity of 99% are used as reinforcing material.

TABLE 3

Chemical composition of AZ31 alloy.

| | Element | | | | | | |
|---|---|---|---|---|---|---|---|
| | Al | Zn | Mn | Si | Cu | Ca | Mg |
| Weight Percent | 2.8 | 94 | 0.42 | 0.05 | 0.01 | 0.04 | Bal. |

An exemplary apparatus similar to apparatus 200 of FIG. 2A was utilized for producing AZ31-$TiO_2$ nanocomposites. A predetermined amount of SiC nanoparticles was added to molten AZ31alloy to obtain a molten mixture containing approximately 1 wt. % of SiC nanoparticles. The obtained molten mixture was then mechanically stirred at 600 and 430 rpm for 7 minutes. A casting mechanism similar to die-casting mechanism 208 was utilized for casting the molten mixture, a squeeze pressure of 80 MPa was applied to the molten mixture by a hydraulic ram similar to ram 282 within pumping chamber 280. Solidification within pumping chamber 280 occurred utilizing two cooling types of cooling with ambient air and cooling with water.

In this example, five different samples were prepared under different stirring rates and cooling conditions. Density of the samples was measured using Archimedes method and the porosity of samples was determined using theoretical densities. In order to investigate the microstructures, samples were etched using a solution of 4.2 g picric acid, 10 ml acetic acid, 10 ml distilled water, and 70 ml ethanol. Optical microscopy (OM), scanning electron microscopy (SEM), energy dispersive spectroscopy (EDS), and x-ray Map analysis are used to determine the grains and distribution of nanoparticles. As well, the Vickers micro hardness (HE) of the samples is determined using a load of 50 g for 15 s.

TABLE 4

Porosity results for different samples

| | Squeeze pressure (MPa) | Stirring Speed (RPM) | Cooling Type | Porosity (%) |
|---|---|---|---|---|
| AZ31 | 80 | — | Air | 0.12 |
| AZ31-1 wt % SiC | 80 | 600 | Water | 0.18 |
| AZ31-1 wt % SiC | 80 | 600 | Air | 0.24 |
| AZ31-1 wt % SiC | 80 | 430 | Water | 0.27 |
| AZ31-1 wt % SiC | 80 | 430 | Air | 0.32 |

Table 4 reports the results of porosity tests performed on the nanocomposite samples. Referring to Table 4, adding SiC nanoparticles increases the porosity of the nanocomposite samples. This increase in porosity is obviously due to presence of voids in clusters and the gas entrapped in the molten metal during casting. However, this incremental increase in the porosity of samples as more nanoparticles are added to the samples is not that significant. Utilizing dispersion mechanism 202 of FIG. 2A may allow for reducing the number of agglomerated nanoparticles in the nanocomposites, which may result in high levels of densities in the samples prepared according to one or more exemplary embodiments of the present disclosure. Referring to Table 4, an incremental increase in stirring speed and cooling rate (by changing the type of cooling) reduces the porosities of the nanocomposite samples. The cooling rate of the molten metal during solidification may affect the degassing efficiency of the molten metal. An incremental change in stirring speed may have two different outcomes, the first outcome is entrapment of more gas inside the metal. The second outcome may be breakage of dendrites, agglomerated nanoparticles, and better distribution of nanoparticles.

Figure 9:
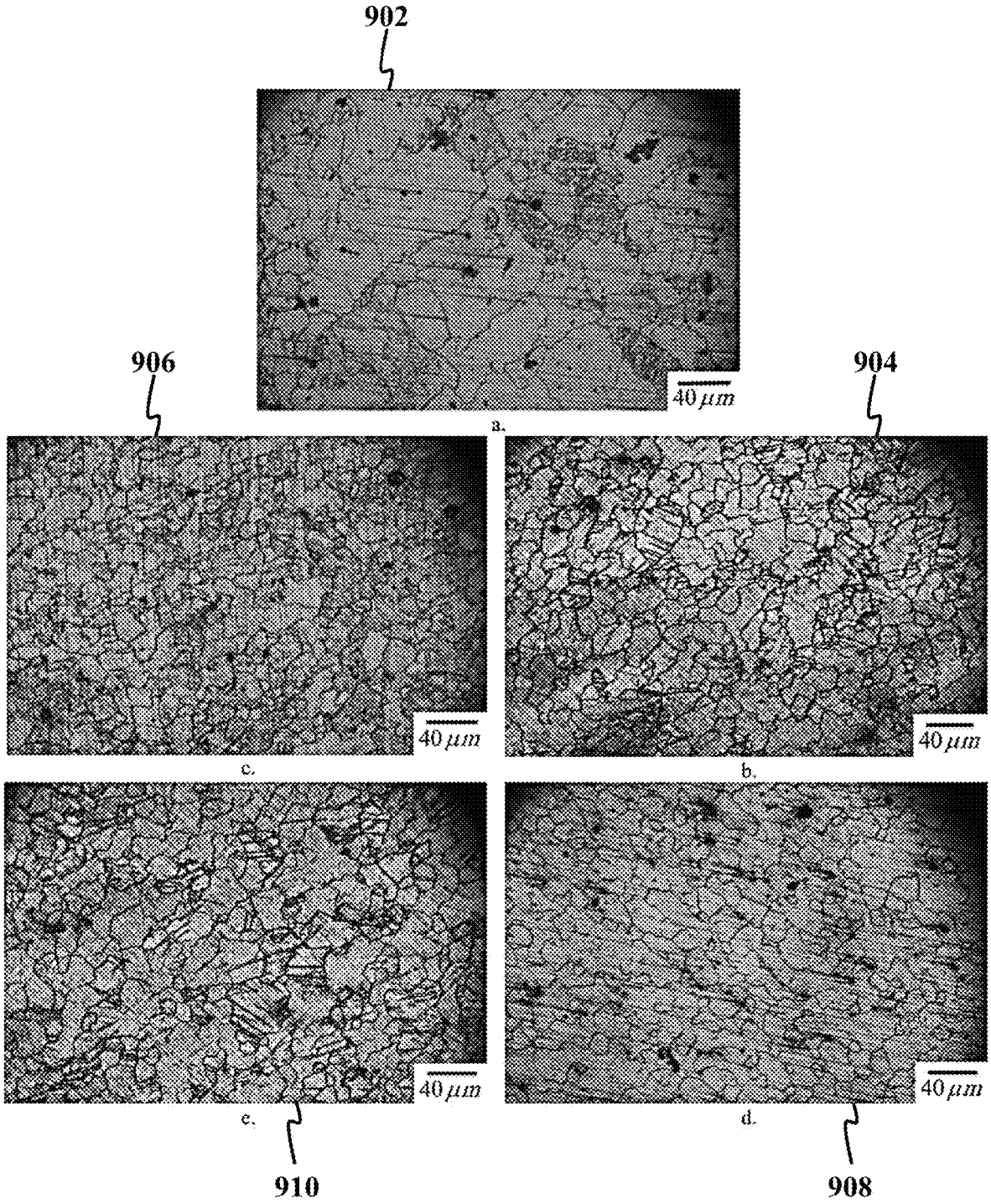
FIG. 9 shows metallography images of AZ31 without reinforcing nanoparticles, AZ31-1 wt % SiC-600 RPM-water cooling, AZ31-1 wt % SiC-600 RPM-air cooling, AZ31-1 wt % SiC-430 RPM-water cooling, and AZ31-1 wt % SiC-430 RPM-air cooling, consistent with an exemplary embodiment of the present disclosure.

FIG. 9 shows metallography images of AZ31 without reinforcing nanoparticles (902), AZ31-1 wt % SiC-600 RPM-water cooling (904), AZ31-1 wt % SiC-600 RPM-air cooling (906), AZ31-1 wt % SiC-430 RPM-water cooling (904), and AZ31-1 wt % SiC-430 RPM-air cooling (906), consistent with one or more exemplary embodiments of the present disclosure. Table 5 reports average grain sizes of the samples. Referring to FIG. 9 and Table 5, the AZ31 alloy without reinforcing nanoparticles has the largest grain size and a non-uniform structure with an average grain size of 97 μm.

TABLE 5

Average grain sizes of nanocomposite samples

| | Squeeze pressure (MPa) | Stirring Speed (RPM) | Cooling Type | Average Grain Size (μm) |
|---|---|---|---|---|
| AZ31 | 80 | — | Air | 97 |
| AZ31-1 wt % SiC | 80 | 600 | Water | 27 |
| AZ31-1 wt % SiC | 80 | 600 | Air | 31 |
| AZ31-1 wt % SiC | 80 | 430 | Water | 29 |
| AZ31-1 wt % SiC | 80 | 430 | Air | 34 |

Figure 10:
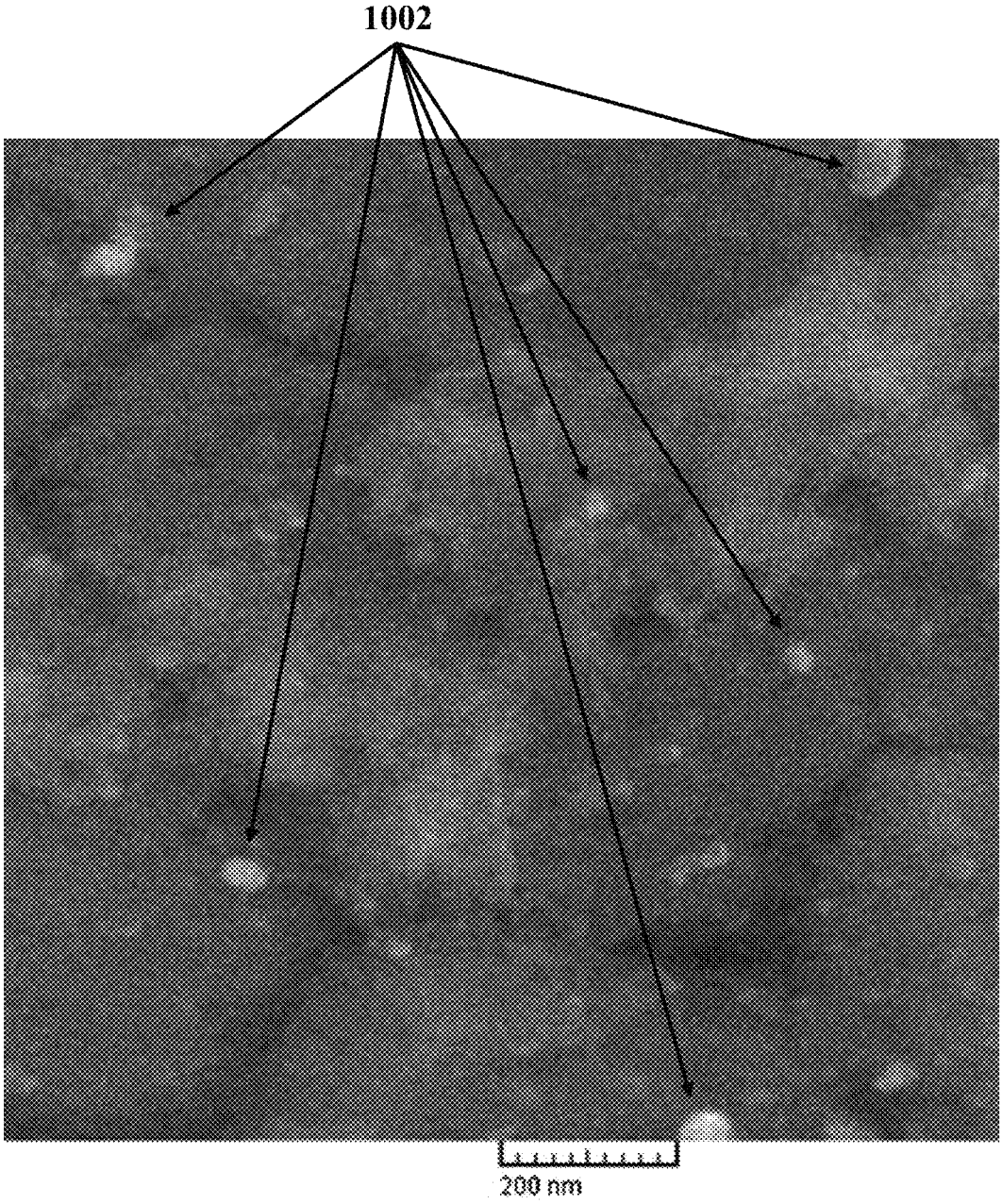
FIG. 10 is an SEM image of AZ31-1 wt % SiC-600 RPM-water cooling nanocomposite, consistent with an exemplary embodiment of the present disclosure.

FIG. 10 is an SEM image of AZ31-1 wt % SiC-600 RPM-water cooling nanocomposite, consistent with one or more exemplary embodiments of the present disclosure. Referring to FIG. 10, a thorough and appropriate distribution of SiC nanoparticles 1002 may be observed which is due to a thorough dispersion of nanoparticles into the molten AZ31 utilizing a dispersion mechanism similar to dispersion mechanism 202 of FIGS. 2A and 2B.

Table 6 reports Vickers micro-hardness of the five samples prepared as described above. Referring to Table 6, the results indicate that the addition of SiC nanoparticles to the AZ31 alloy may increase the hardness of the fabricated nanocomposite samples. The highest hardness result was obtained for the sample produced with a stirring speed of 600 RPM and rapid cooling of the molten mixture using water.

TABLE 6

Vickers micro-hardness of different samples.

| | Squeeze pressure (MPa) | Stirring Speed (RPM) | Cooling Type | Hardness (HV) |
|---|---|---|---|---|
| AZ31 | 80 | — | Air | 53.7 |
| AZ31-1 wt % SiC | 80 | 600 | Water | 108.3 ± 2.5 |
| AZ31-1 wt % SiC | 80 | 600 | Air | 103 ± 3.2 |
| AZ31-1 wt % SiC | 80 | 430 | Water | 103.8 ± 4 |
| AZ31-1 wt % SiC | 80 | 430 | Air | 91.6 ± 5.1 |

Table 6 reports values of yield stress, ultimate stress and elongation for the five samples prepared as described above. Referring to Table 6, adding SiC nanoparticles to the AZ31 alloy under all production conditions, increases the yield stress, ultimate stress and elongation of the samples. The increase in the yield stress of the nanocomposite samples in comparison with AZ31 alloy is not significant like the increases in the ultimate stress and the elongation of the nanocomposite samples. This may be due to the fact that the yield stress is dependent on the grain size and density of dislocations. On the other hand, the remarkable changes in the ultimate stresses and the elongations of the nanocomposites may be attributed to the removal of structural defects and formation of uniform microstructures. Referring to Table 6, increasing the stirring speed from 430 RPM to 600 RPM leads to an increase in the yield stress, ultimate stress and elongation by 15.9, 29 and 7.1 for air cooling condition and by 9.5, 26.35 and 4.4 for water cooling condition, respectively. Increasing the stirring speed leads to a reduction in the average grain size of the nanocomposites and an increase in the uniformity of the nanocomposites. Furthermore, increasing the stirring speed improves the uniform distribution of nanoparticles.

TABLE 6

Values of yield stress, ultimate stress, and elongation for different samples.

| | Yield Stress (MPa) | Ultimate Stress (MPa) | Elongation (%) |
|---|---|---|---|
| AZ31 | 70.83 | 166.72 | 6.64 |
| AZ31-1 wt % SiC-600 RPM-water cooling | 122.13 | 300.73 | 10.84 |
| AZ31-1 wt % SiC-600 RPM-air cooling | 118.5 | 253.80 | 10.01 |
| AZ31-1 wt % SiC-430 RPM-water cooling | 111.5 | 238.01 | 10.38 |
| AZ31-1 wt % SiC-430 RPM-air cooling | 102.21 | 196.68 | 9.34 |

In Examples 1 and 2 above, different samples of metal matrix nanocomposites were produced by an exemplary method similar to method 100 of FIG. 1, which may be implemented in an exemplary apparatus similar to apparatus 200 of FIG. 2A. Effective dispersion of nanoparticles utilizing exemplary dispersion mechanisms similar to dispersion mechanism 202 of apparatus 200 and then controlled injection of the dispersed nanoparticles into the molten metal may increase the wettability of the particles and may allow for a uniform nanoparticle distribution within the metal matrix. This uniform distribution of nanoparticles in the absence of any particle agglomeration improves mechanical properties of the as-produced nanocomposites as was discussed in detail in Examples 1 and 2.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A method for producing metal matrix nanocomposites, the method comprising:

obtaining a nanodispersion by dispersing a plurality of nanoparticles into an inert gas within a dispersion chamber, the dispersing the plurality of nanoparticles into the inert gas comprising:

injecting a pressurized stream of the inert gas into the dispersion chamber; and mechanically mixing the inert gas and the plurality of nanoparticles;

injecting the nanodispersion into an air-tight crucible containing a volume of a molten metal, injecting the nanodispersion into the air-tight crucible comprising injecting the nanodispersion into the volume of the molten metal;

obtaining a molten mixture by mechanically mixing the nanodispersion with the volume of the molten metal; and applying a casting process on the molten mixture by transferring the molten mixture into a die, wherein the air-tight crucible comprises: a second mixing mechanism disposed within the air-tight crucible, the second mixing mechanism comprising at least one impeller inserted into the volume of the molten metal; and an injection probe inserted within the volume of the molten metal, a tip of the injection probe dipped into the volume of the molten metal positioned immediately above the at least one impeller, wherein mechanically mixing the nanodispersion with the volume of molten metal comprises mixing the nanodispersion with the volume of molten metal by the second mixing mechanism, and wherein injecting the nanodispersion into the volume of the molten metal comprises injecting the nanodispersion into the volume of molten metal immediately above the at least one impeller via the injection probe, wherein the air-tight crucible further comprises: a crucible body comprising an upper opening; a crucible cap; a gas inlet port in fluid communication with an inner volume of the crucible body; and a gas outlet port in fluid communication with an inner volume of the crucible body, wherein injecting the nanodispersion into the air-tight crucible containing the volume of the molten metal further comprises: pouring the volume of the molten metal into the air-tight crucible via the upper opening; sealing the upper opening utilizing the crucible cap; and providing a stream of inert gas within the air-tight crucible by injecting the inert gas into the air-tight crucible via the gas inlet port and discharging the inert gas out of the air-tight crucible via the outlet port.

2. The method according to claim 1, wherein injecting the pressurized stream of the inert gas into the dispersion chamber comprises injecting the pressurized stream of the inert gas into a cylindrical dispersion chamber through an inlet port tangentially connected in fluid communication with the cylindrical dispersion chamber.

3. The method according to claim 1, wherein injecting the pressurized stream of the inert gas into the dispersion chamber comprises injecting the pressurized stream of the inert gas into a cylindrical dispersion chamber through an inlet port tangentially connected in fluid communication with a lower portion of the cylindrical dispersion chamber.

4. The method according to claim 1, wherein mechanically mixing the inert gas and the plurality of nanoparticles comprises mixing the inert gas and the plurality of nanoparticles utilizing a first mixing mechanism disposed within the dispersion chamber, the first mixing mechanism comprising at least one axial-flow impeller mounted on an impeller shaft, the impeller shaft driven by an impeller actuator.

5. The method according to claim 4, wherein injecting the pressurized stream of the inert gas into the dispersion chamber comprises injecting the pressurized stream of the inert gas into the dispersion chamber such that the pressurized stream of the inert gas is injected tangential to a trailing-edge circle of the at least one axial-flow impeller.

6. The method according to claim 1, wherein transferring the molten mixture into the die comprises:

pouring the molten mixture into a pumping chamber; and forcing the molten mixture into the die by a ram movably disposed within the pumping chamber, the ram directing the molten metal within the pumping chamber into the die.

7. The method according to claim 1, wherein injecting the nanodispersion into an air-tight crucible containing the volume of the molten metal comprises injecting the nanodispersion into the volume of the molten metal through an injection line in fluid communication with a discharge port, the discharge port connected in fluid communication with an upper portion of the cylindrical dispersion chamber.

8. The method according to claim 1, wherein injecting the pressurized stream of the inert gas into the dispersion chamber comprises injecting the pressurized stream of the inert gas into a cylindrical dispersion chamber through an inlet port tangentially connected in fluid communication with a lower portion of the cylindrical dispersion chamber.

9. The method according to claim 1, wherein injecting the pressurized stream of the inert gas into the dispersion chamber comprises injecting the pressurized stream of the inert gas into a cylindrical dispersion chamber through an inlet port tangentially connected in fluid communication with a lower portion of the cylindrical dispersion chamber.

10. The method according to claim 9, wherein mechanically mixing the inert gas and the plurality of nanoparticles comprises mixing the inert gas and the plurality of nanoparticles utilizing a first mixing mechanism disposed within the dispersion chamber, the first mixing mechanism comprising at least one axial-flow impeller mounted on an impeller shaft, the impeller shaft driven by an impeller actuator.

11. The method according to claim 10, wherein injecting the pressurized stream of the inert gas into the dispersion chamber comprises injecting the pressurized stream of the inert gas into the dispersion chamber such that the pressurized stream of the inert gas is injected tangential to a trailing-edge circle of the at least one axial-flow impeller.

12. The method according to claim 1, wherein the crucible body further comprises a cone-shaped conduit, a fluid communication between the cone-shaped conduit and the die intercepted by a gate valve, wherein transferring the molten mixture into the die comprises:

pouring the molten mixture into a pumping chamber by opening the gate valve; and forcing the molten mixture into the die by a ram movably disposed within the pumping chamber, the ram directing the molten metal within the pumping chamber into the die.

13. The method according to claim 1, wherein obtaining the nanodispersion comprises dispersing a plurality of $TiO_2$ nanoparticles into the inert gas within the dispersion chamber, the inert gas comprising argon.

14. The method according to claim 13, wherein injecting the nanodispersion into the air-tight crucible containing the volume of the molten metal comprises injecting the nanodispersion into the volume of the molten metal, the molten metal comprising molten aluminum.

* * * * *